US008203448B2

(12) United States Patent
Chien et al.

(10) Patent No.: US 8,203,448 B2
(45) Date of Patent: Jun. 19, 2012

(54) FOREIGN OBJECT DETECTING APPARATUS IN A BILL PASSAGEWAY

(75) Inventors: Tien-Yuan Chien, Taipei (TW); Cheng-Kang Yu, Taipei (TW); Fu-Yuan Chang, Taipei (TW)

(73) Assignee: International Currency Technologies Corp., Taipei (TW)

( * ) Notice: Subject to any disclaimer, the term of this patent is extended or adjusted under 35 U.S.C. 154(b) by 413 days.

(21) Appl. No.: 12/480,902

(22) Filed: Jun. 9, 2009

(65) Prior Publication Data

US 2010/0271203 A1 Oct. 28, 2010

(30) Foreign Application Priority Data

Apr. 28, 2009 (TW) ..... 98114294 A

(51) Int. Cl.
*G08B 21/00* (2006.01)

(52) U.S. Cl. ..... 340/540; 340/541; 340/568.7; 235/379; 250/556; 250/557; 194/203; 194/207

(58) Field of Classification Search ..... 340/540, 340/568.7, 673, 5.41, 541; 235/379, 380; 250/556, 557; 194/203, 207
See application file for complete search history.

(56) References Cited

U.S. PATENT DOCUMENTS

| | | | | |
|---|---|---|---|---|
| 5,806,649 | A | 9/1998 | Walsh et al. | |
| 5,988,345 | A * | 11/1999 | Bergeron et al. | 194/203 |
| 6,441,891 | B1 * | 8/2002 | Levasseur et al. | 356/71 |
| 6,648,221 | B2 * | 11/2003 | Thawley et al. | 235/379 |
| 2006/0231856 | A1 * | 10/2006 | Kanno et al. | 257/99 |
| 2009/0294245 | A1 * | 12/2009 | Paczkowski | 194/206 |

FOREIGN PATENT DOCUMENTS

WO WO0244985 A1 6/2002

OTHER PUBLICATIONS

Search Report.

* cited by examiner

*Primary Examiner* — Hung T. Nguyen
(74) *Attorney, Agent, or Firm* — Chun-Ming Shih; HDLS IPR Services

(57) ABSTRACT

A foreign object detecting apparatus in bill passageway includes a laser light source, a first light detector and a second light detector. The laser light source is arranged in a first lateral side to emit a coherent laser beam toward a second lateral side. The first light detector is arranged in the second lateral side to receive the coherent laser beam and to measure the intensity of the coherent laser beam. The second light detector is arranged in one of a top side and a bottom side, wherein when a foreign object is presence in the bill passageway, the intensity of the coherent laser beam received by the first light detector is decreased by the blocking of the foreign object, and at least a portion of the coherent laser beam which is reflected, refracted, diffracted or scattered by the foreign object is received by the second light detector.

19 Claims, 12 Drawing Sheets

FOREIGN OBJECT DETECTING APPARATUS IN A BILL PASSAGEWAY

BACKGROUND OF THE INVENTION

1. Field of the Invention

The present invention relates to a detecting device, in particular to an apparatus for detecting a foreign object in a bill passageway.

2. Description of Related Art

As people require high efficiency and convenience in modern life, many kinds of automatic trading machines are located at many public places, such as automatic ticket seller machine, automatic exchange machine and automatic teller machine. However, some of those automatic trading machines are not under well monitored in those public places. Therefore, a bill validator is often installed in those automatic trading machines to prevent counterfeit bill. And kinds of anti-stealing devices are installed in those automatic trading machines to prevent bill stealing.

One kind of bills stealing is performed by attaching a foreign object like a wire, a string or a tape onto a bill. After the bill is inserted into the automatic trading machine and passes through the reorganization and is recorded by the automatic trading machine, the bill is pulled out from the automatic trading machine by the wire. In order to prevent this kind of bill stealing, kinds of detecting device is installed in the automatic trading machine to detect the foreign object attached on the bill. Then the automatic trading machine can shut down the power by itself or can cut off the foreign object attached on the bill by corresponding device to prevent bill from pulling out.

Conventional foreign object detecting apparatus installed in the bill passageway of the automatic trading machine has a light emitting diode arranged at a side of the passageway to be a light source. The light emitting diode emits a light beam across the passageway after the bill passing through the passageway. And a light detector is utilized to receive the light beam passed through the passageway. If the light is once blocked by the foreign object, the light detector will sense the variation of light beam so as to discover the presence of the foreign object.

However, the conventional foreign object detecting apparatus has its natural limitation of resolution and the very thin wire is difficult to be discovered. Therefore, a foreign object detecting apparatus with better resolution needs to be invented to well prevent the happen of those bill stealing.

SUMMARY OF THE INVENTION

The object of the present invention is to provide a foreign object detecting apparatus in bill passageway with better resolution, which is capable of detecting thinner wire and is used to well prevent the happen of bill stealing.

In order to achieve aforementioned purpose, the present invention provides a foreign object detecting apparatus in bill passageway, which is arranged in a bill validator and used to detect the presence of a foreign object in a bill passageway. The bill passageway has a top side, a bottom side, a first lateral side and a second lateral side opposite to the first lateral side. The foreign object detecting apparatus in bill passageway includes a laser light source, a first light detector and a second light detector. The laser light source is arranged in the first lateral side to emit a coherent laser beam toward the second lateral side. The first light detector is arranged in the second lateral side to receive the coherent laser beam and to measure the intensity of the coherent laser beam. The second light detector is arranged in one of the top side and the bottom side, wherein when a foreign object is presence in the bill passageway, the intensity of the coherent laser beam received by the first light detector is decreased by the blocking of the foreign object, and at least a portion of the coherent laser beam which is reflected, refracted, diffracted or scattered by the foreign object is received by the second light detector.

The present invention also provides a foreign object detecting apparatus in bill passageway, which is arranged in a bill validator and used to detect the presence of a foreign object in a bill passageway. The bill passageway has a top side, a bottom side, a first lateral side and a second lateral side opposite to the first lateral side. The foreign object detecting apparatus in bill passageway includes a laser light source, a reflector, a first light detector and a second light detector. The laser light source is arranged in the first lateral side to emit a coherent laser beam toward the second lateral side. The reflector is arranged in the second lateral side to reflect the coherent laser beam back to the first lateral side. The first light detector is arranged in the first lateral side to receive the coherent laser beam reflected by the reflector and to measure the intensity of the coherent laser beam. The second light detector is arranged in one of the top side and the bottom side, wherein when a foreign object is presence in the bill passageway, the intensity of the coherent laser beam received by the first light detector is decreased by the blocking of the foreign object, and at least a portion of the coherent laser beam which is reflected, refracted, diffracted or scattered by the foreign object is received by the second light detector.

BRIEF DESCRIPTION OF THE DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

A detailed description of the present invention will be made with reference to the accompanying drawings.

Figure 1:
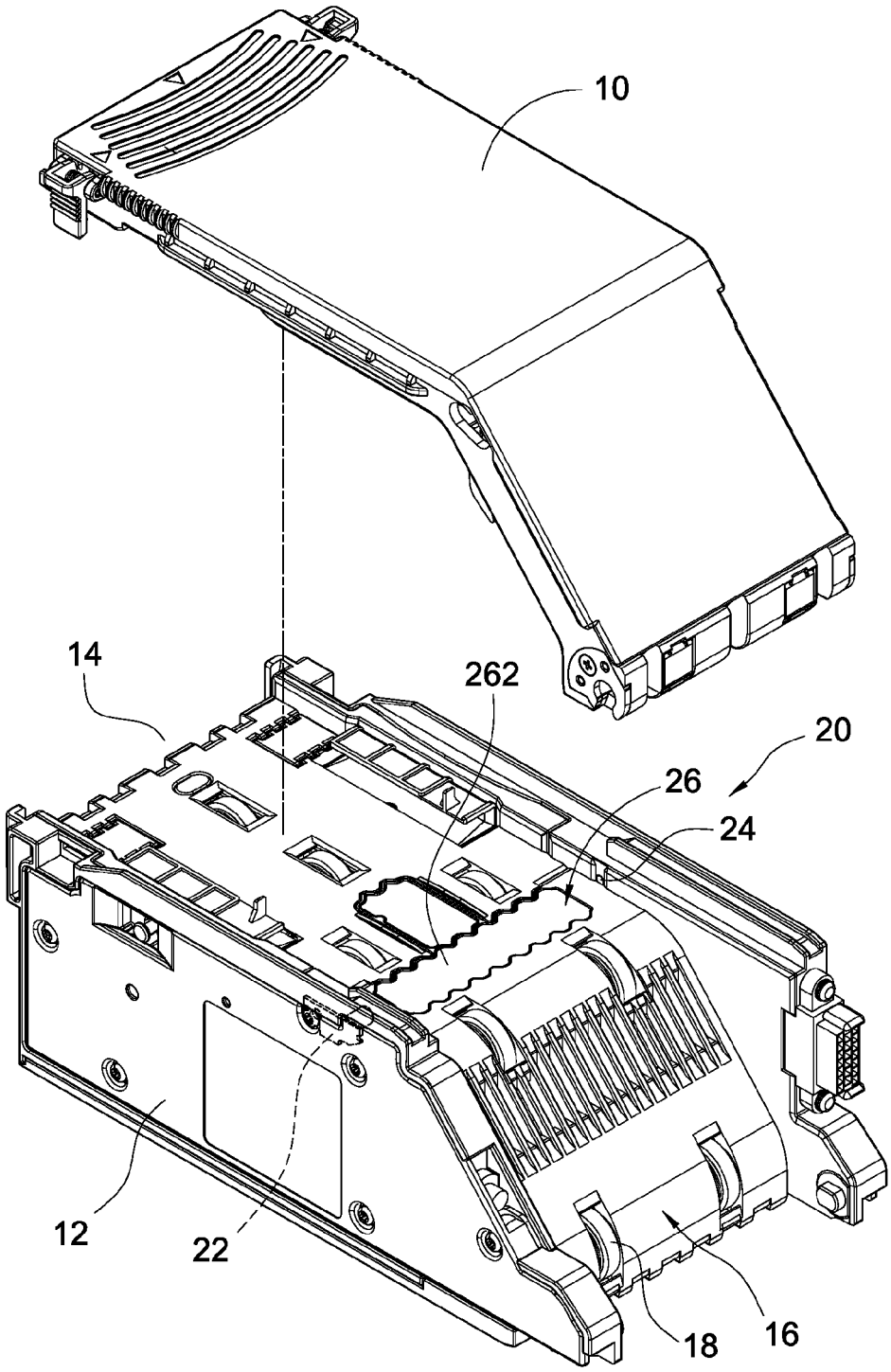
FIG. 1 is a perspective view of a foreign object detecting apparatus according to a first embodiment of the present invention.
Figure 2:
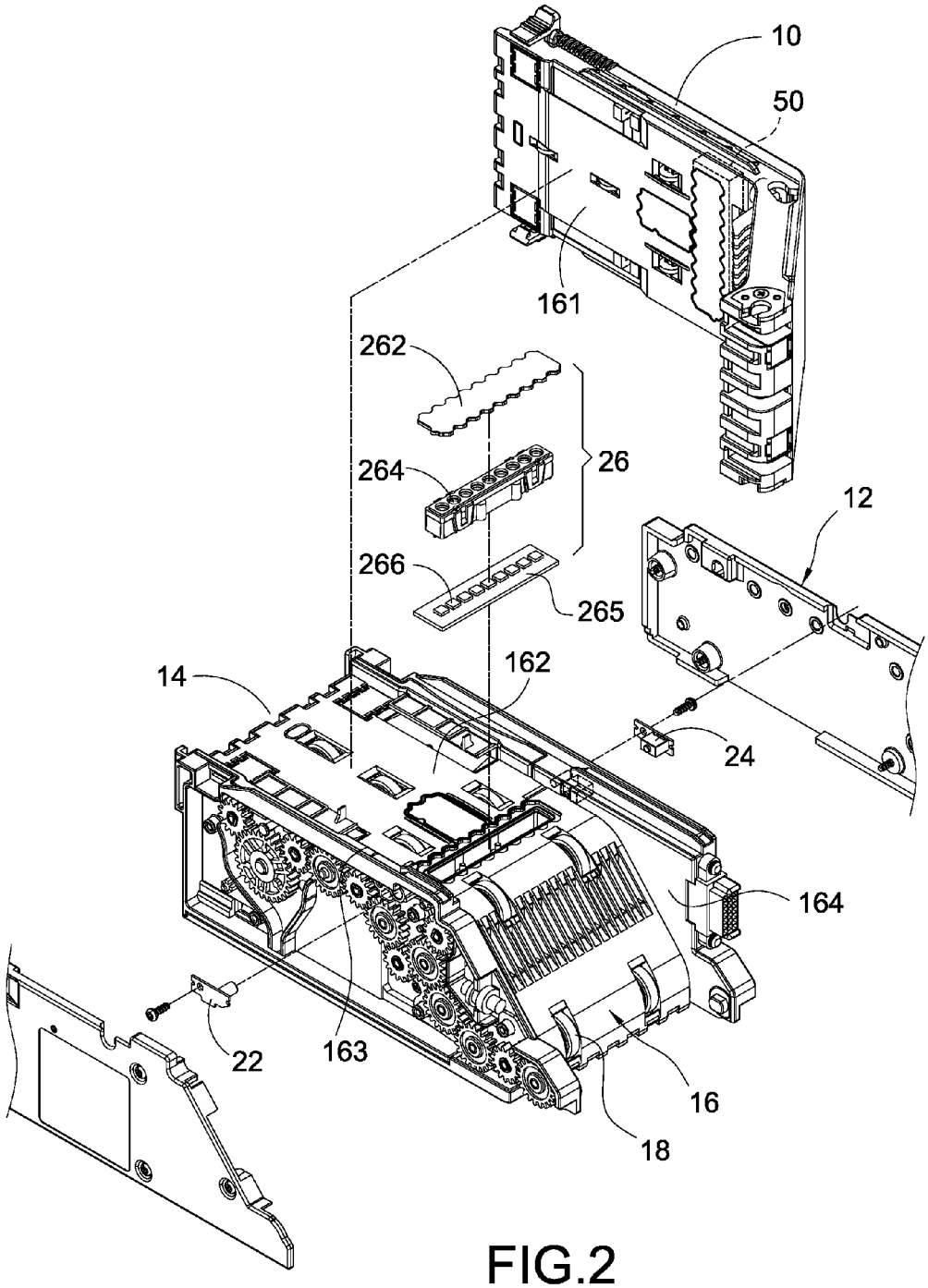
FIG. 2 is a perspective view of the foreign object detecting apparatus.

FIG. 1 and FIG. 2 show a foreign object detecting apparatus in bill passageway 20 according to a first embodiment of the present invention. The foreign object detecting apparatus in bill passageway 20 is used for arranging in a bill validator of an automatic trading machine and is used to detect the presence of a foreign object like a opaque wire or a transparent wire attached on a bill in a bill passageway 16 of the bill validator. The opaque wire may be a silk wire, a cotton wire or a cotton wire but not limited to. The transparent wire may be a nylon wire but not limited to.

The bill validator includes an upper base 10, a lower base 12 and a foreign object detecting apparatus 20. The upper base 10 connects with the lower base 12. The upper base 10 and the lower base 12 form a bill inlet 14 and a bill passageway 16 inwardly extended from the bill inlet 14. The bill passageway 16 is used for passing through the bill. The bill passageway 16 has a top side 161, a bottom side 162, a first lateral side 163 and a second lateral side 164 opposite to the first lateral side 163. A bill storage device (not shown) can be connected with the bill passageway 16 for storing the bill.

A plurality of pulleys 18 respectively arranged on the upper base 10 and lower base 12 to smoothly guide the bill transporting in the bill passageway 16. The foreign object detecting apparatus 20 includes a laser light source 22, a first light detector 24, a second light detector 26 and a third light detector 50.

The laser light source 22 is arranged in the first lateral side 163 of the bill passageway 16 and used to emit a coherent laser beam toward the second lateral side 164 for detecting the foreign object. The first light detector 24 is arranged in the second lateral side 164 of the bill passageway 16 and used to receive the coherent laser beam and to measure the intensity of the coherent laser beam. The second light detector 26 is arranged in the bottom side 162 of the bill passageway 16 (on the lower base 12). The third light detector 50 is arranged in the top side 161 of the bill passageway 16 (on the upper base 10). The laser light source 22 is a laser diode.

The second light detector 26 includes a circuit board 265, a plurality of light detecting chips 266 arranged on the circuit board 265, a lens set 264 arranged above the light detecting chips 266 and a transparent cover 262. The third light detector 50 is the same as the second light detector 26. The second light detector 26 and the third light detector 50 can also be a photo sensor, photo diode, or a contact image sensor.

Figure 3:
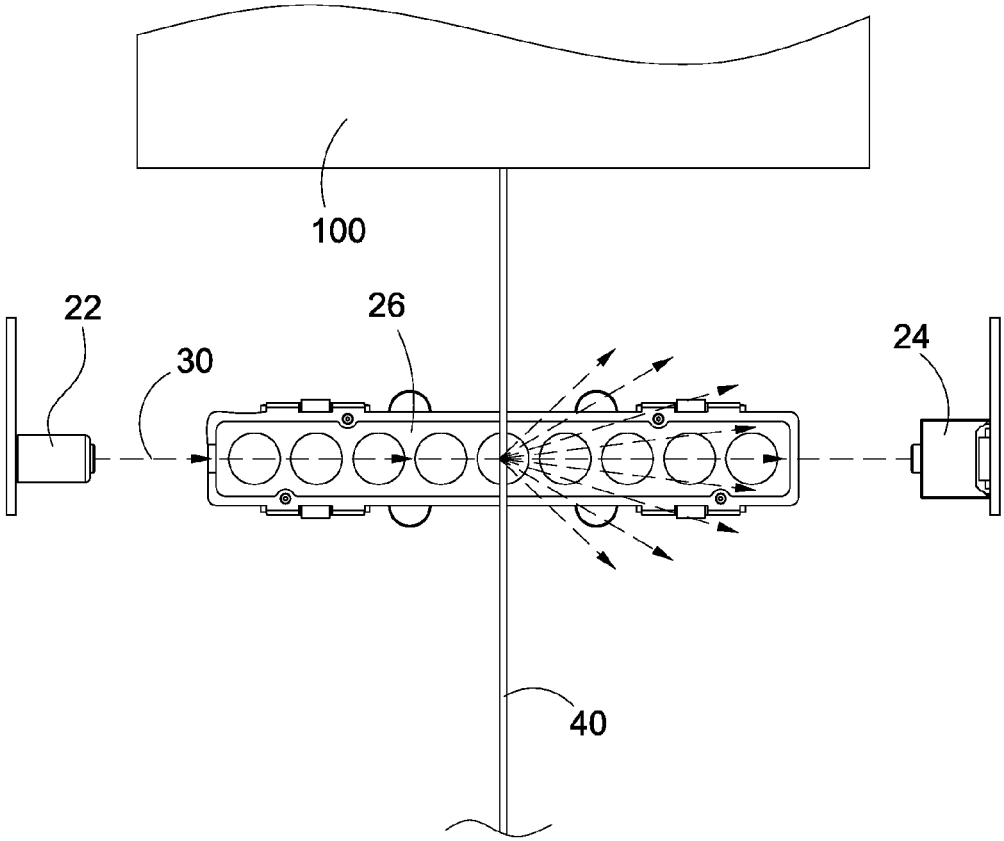
FIG. 3 is a top schematic view of the foreign object detecting apparatus.
Figure 4:
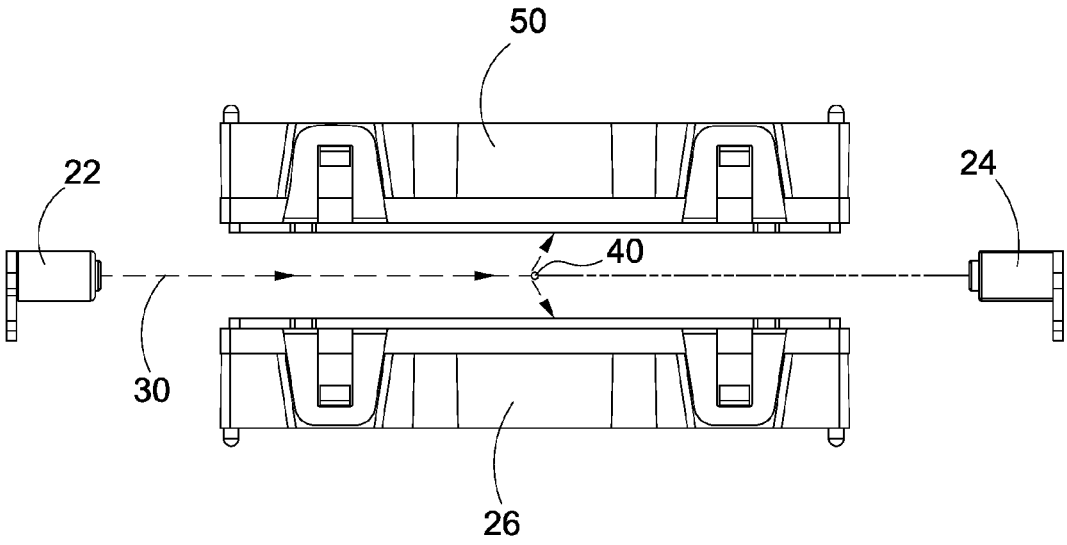
FIG. 4 is side schematic view of the foreign object detecting apparatus.

FIG. 3 and FIG. 4 respectively show a top side schematic view and a lateral side schematic view of the first embodiment of the present invention. The coherent laser beam 30 is emitted by the laser light source 22 and passes through the bill passageway 16 and then is received by the first light detector 24. Because the coherent laser beam 30 has characteristics including coherence and well collimated, it can emitted to the first light detector 24 nearly without any divergence. Such that the second light detector 26 and the third detector 50 can nearly receive any part of the coherent laser beam 30.

In practical use, when a bill 100 is inserted into the bill passageway 16 by a user, the bill 100 is guided by those pulleys 18 and passes through the bill passageway 16. After the bill 100 passing through the bill passageway 16, if there is nothing in the bill passageway 16, the first light detector 24 can measure a predetermined intensity of the coherent laser beam 30 and the second light detector 26 and the third light detector 50 can not detect any light.

In the contrast, if there is a foreign object like a wire in the bill passageway 16 after the bill 100 passed through the bill passageway 16, the coherent laser beam 30 emitted from the laser light source 22 will be blocked by the foreign object 40, and the intensity of coherent laser beam 30 measured by the first light detector 24 will decrease.

If the foreign object 40 is opaque, at least a portion of the coherent laser beam 30 will be reflected, diffracted or scattered by the foreign object 40 and then received by the second light detector 26 or the third light detector 50. If the foreign object 40 is transparent, at least a portion of the coherent laser beam 30 will be reflected, refracted, diffracted or scattered by the foreign object 40 and then received by the second light detector 26 or the third light detector 50.

When the intensity of the coherent laser beam 30 measured by the first light detector 24 is decreased, and at least a portion of the coherent laser beam 30 is received by the second light detector 26 or the third light detector 50 at the same time, the foreign object 40 in bill passageway 16 is discovered by the foreign object detecting apparatus 20 of the present invention.

Although both the second light detector 26 and the third light detector 50 are applied to detect the coherent laser beam 30 in this embodiment, in practical use, one of the second light detector 26 and the third light detector 50 is enough to receive the coherent laser beam 30 as to discover the foreign object 40 in bill passageway 16.

Figure 5:
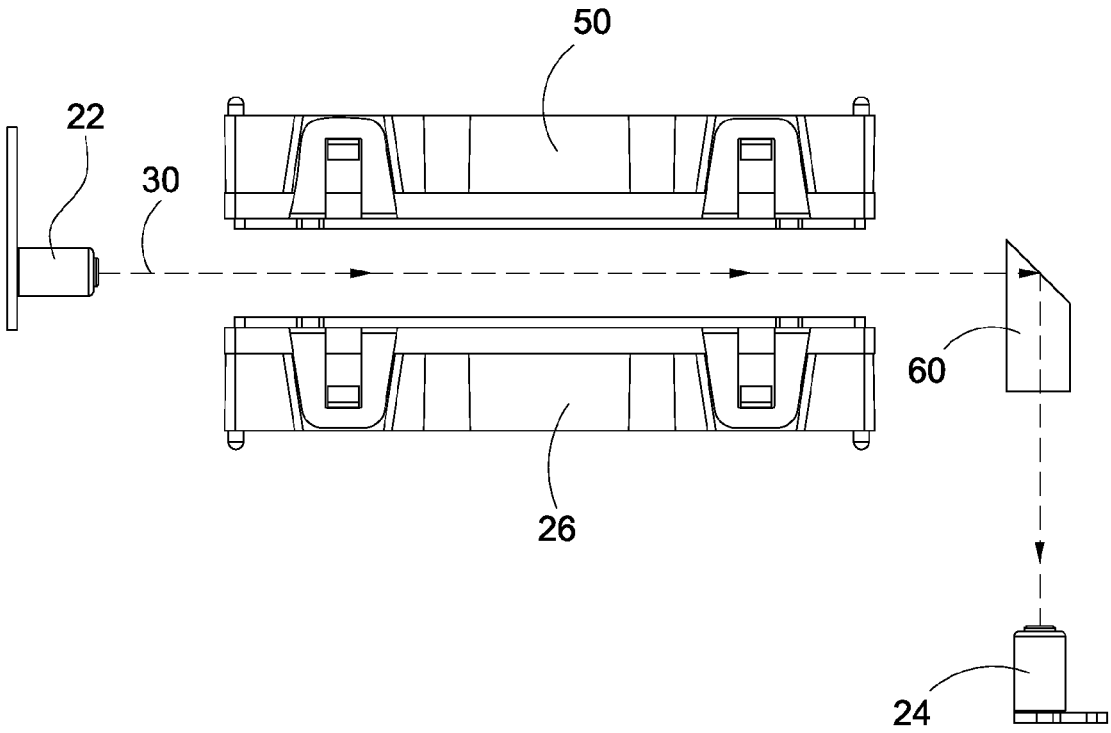
FIG. 5 is a side schematic view of a foreign object detecting apparatus according to the second embodiment of the present invention.
Figure 6:
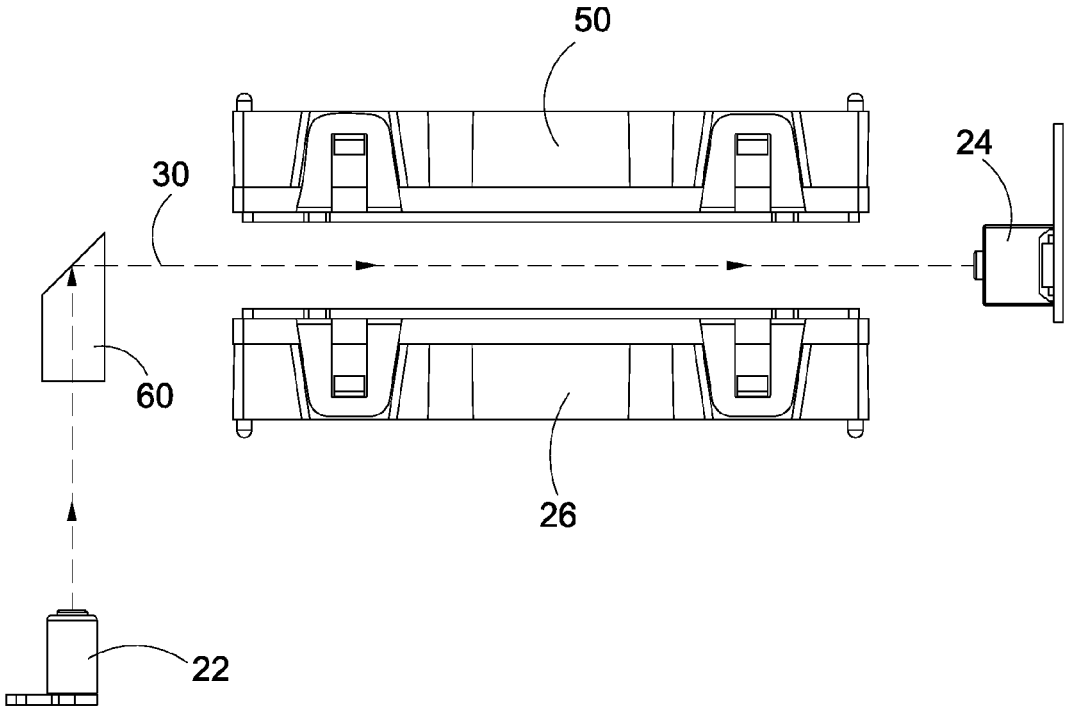
FIG. 6 is a side schematic view of a foreign object detecting apparatus according to the third embodiment of the present invention.

FIG. 5 and FIG. 6 respectively show the foreign object detecting apparatus 20 according to the second and third embodiments of the present invention, which both are similar to the foreign object detecting apparatus 20 according the first embodiment. The difference between the second and third embodiments and the first embodiment is that there is a reflecting device 60 used for redirecting the coherent laser beam 30 emitted from the laser light source 22 to the second lateral side 164. The reflecting device 60 can be a prism.

Figure 7:
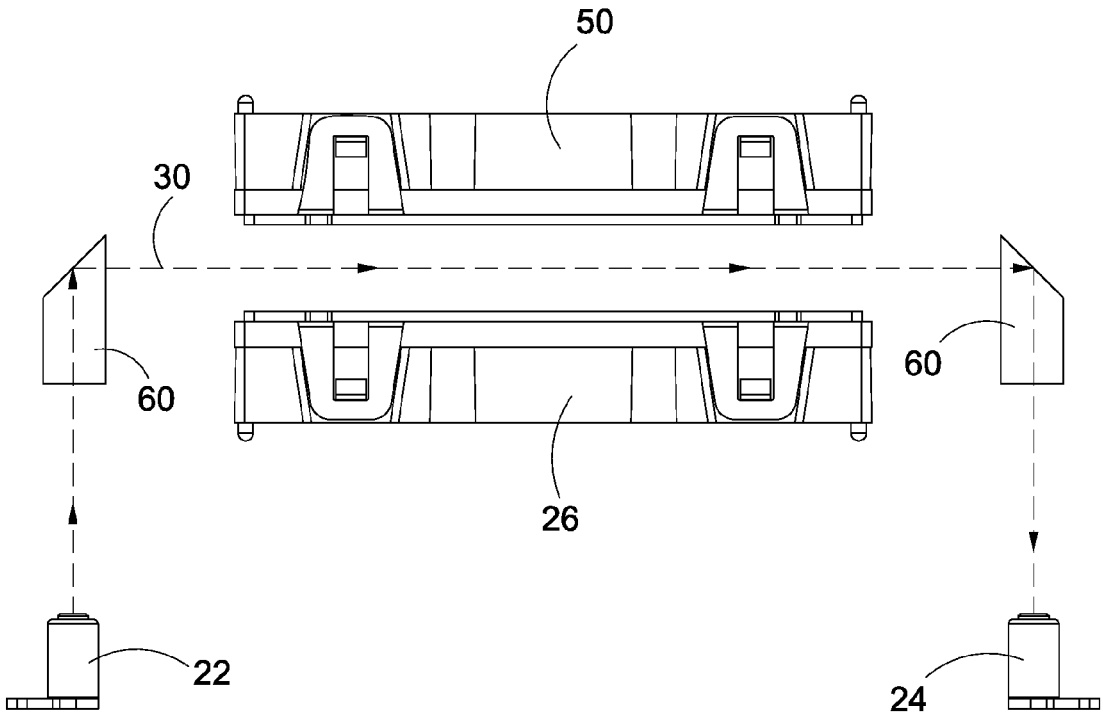
FIG. 7 is a side schematic view of a foreign object detecting apparatus according to the forth embodiment of the present invention.
Figure 8:
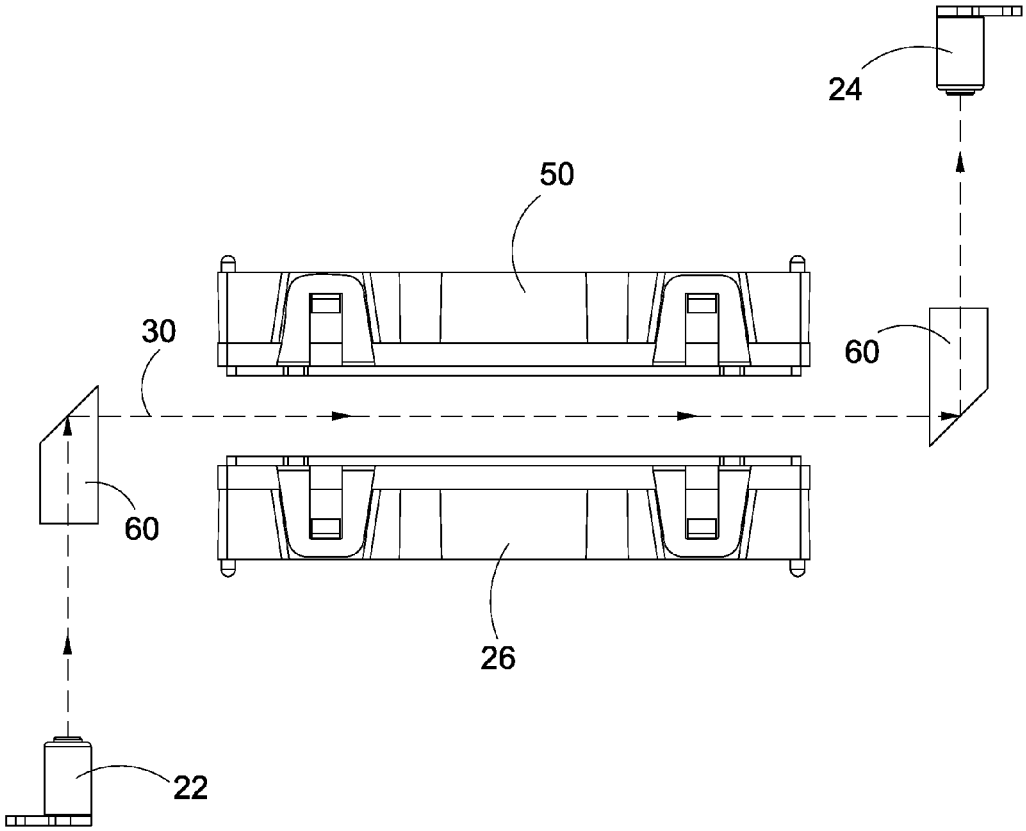
FIG. 8 is a side schematic view of a foreign object detecting apparatus according to the fifth embodiment of the present invention.

FIG. 7 and FIG. 8 respectively show the foreign object detecting apparatus 20 according to the forth and the fifth embodiments of the present invention, which both are similar to the foreign object detecting apparatus 20 according the third embodiment. The difference between the forth and five embodiments and the third embodiment is that there is another reflecting device 60 used for redirecting the coherent laser beam 30 from the first lateral side 163 to the first light detector 24. The reflecting device 60 can be a prism.

Figure 9:
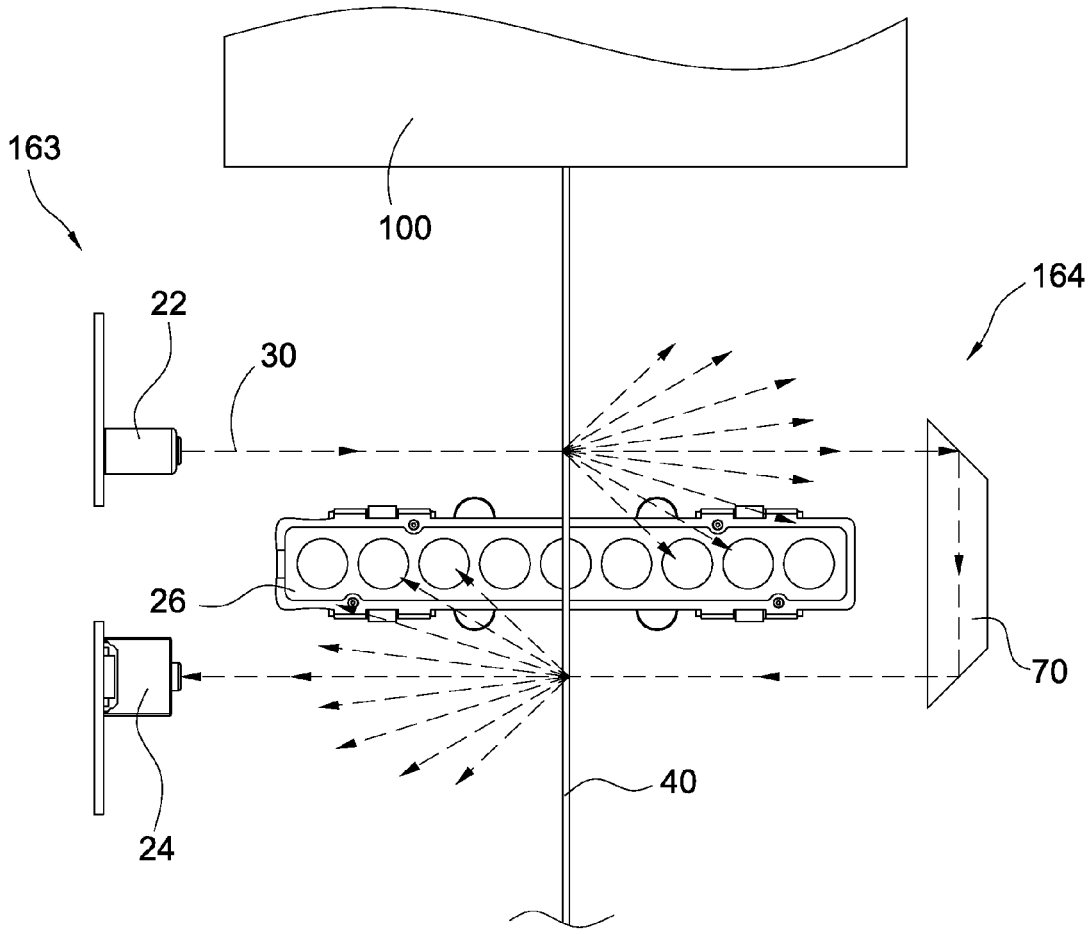
FIG. 9 is a top schematic view of a foreign object detecting apparatus according to the sixth embodiment of the present invention.

FIG. 9 show the foreign object detecting apparatus 20 according to the sixth embodiment of the present invention, which is similar to the foreign object detecting apparatus 20 according the third embodiment. The difference is that the laser light source 22 and the first light detector 24 both are arranged in the first lateral side 163, and a reflector 70 is arranged in the second lateral side 164 to reflect the coherent laser beam 30 back to the first lateral side 163. The reflector 70 can be a prism.

Figure 10:
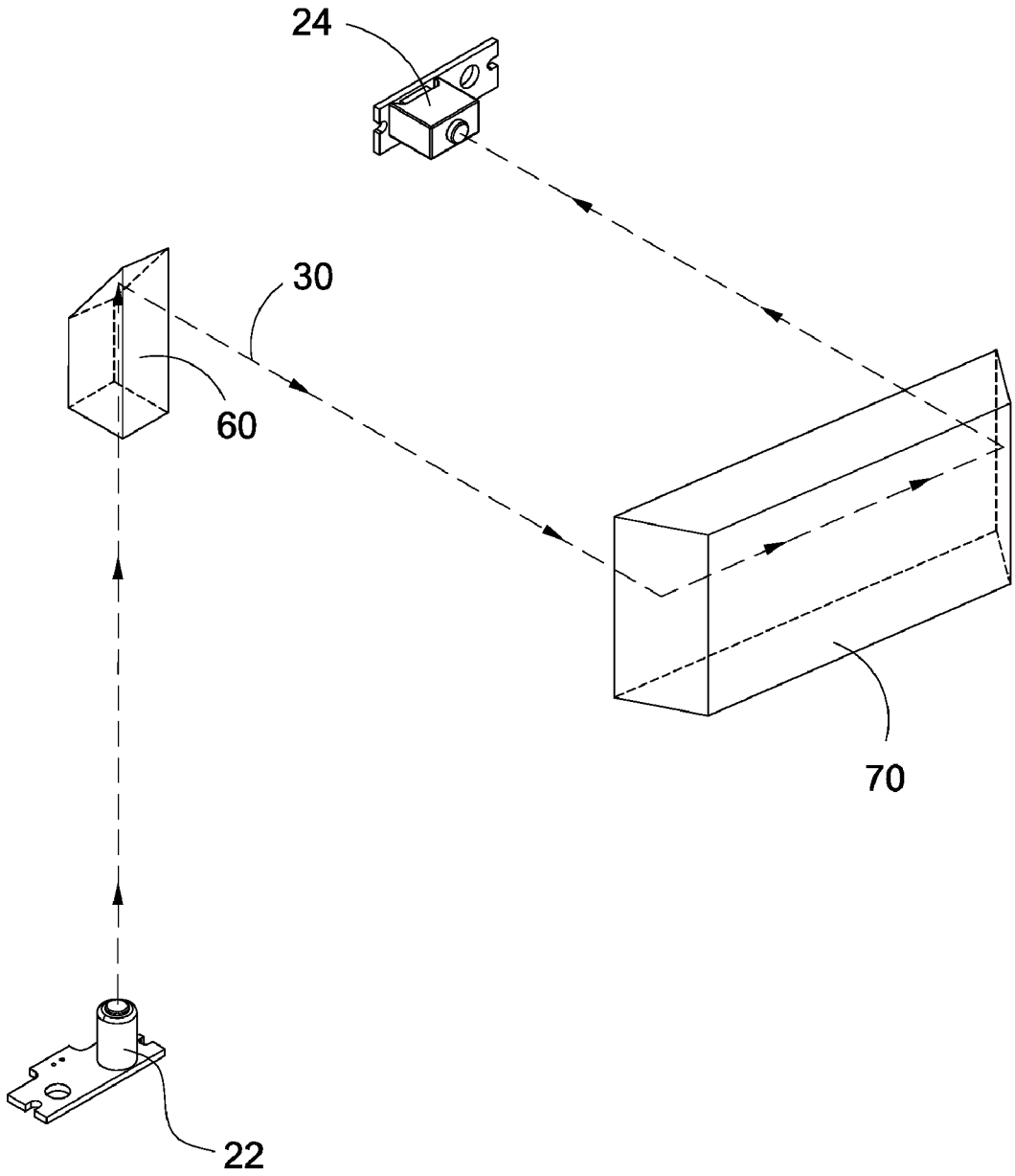
FIG. 10 is a schematic view of a foreign object detecting apparatus according to the seventh embodiment of the present invention.
Figure 11:
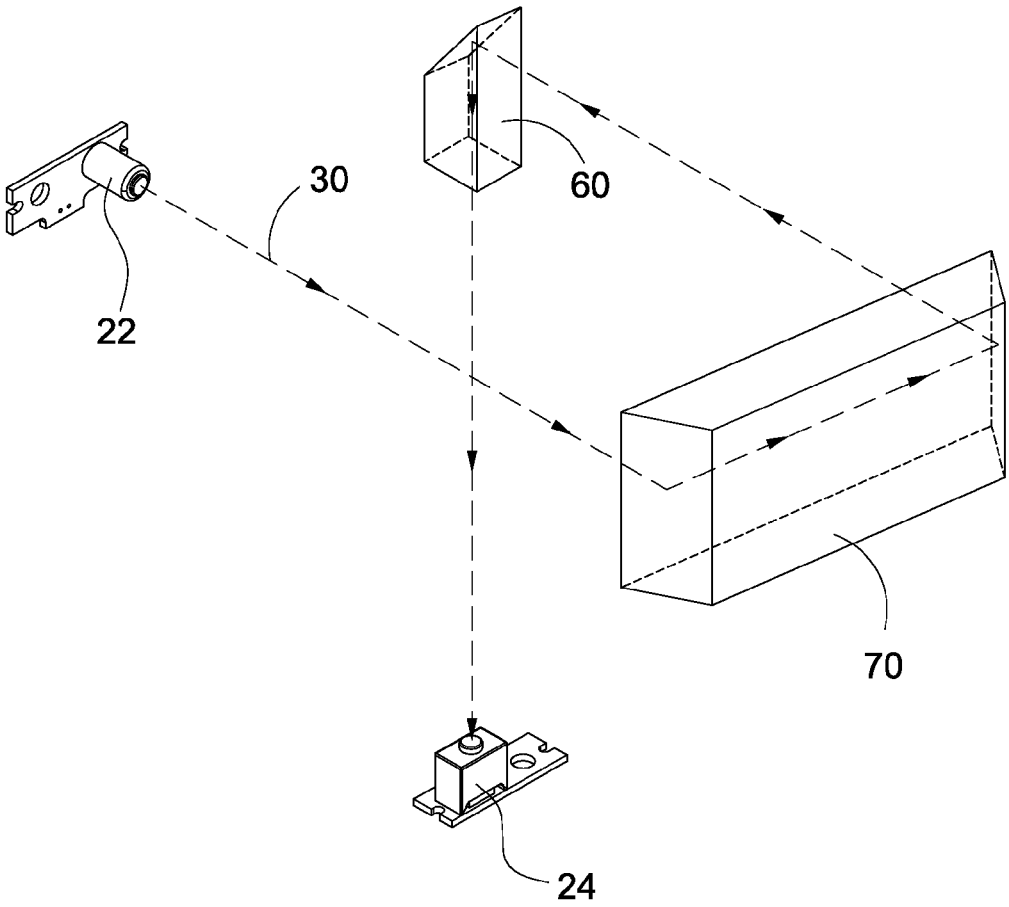
FIG. 11 is a schematic view of a foreign object detecting apparatus according to the eighth embodiment of the present invention.
Figure 12:
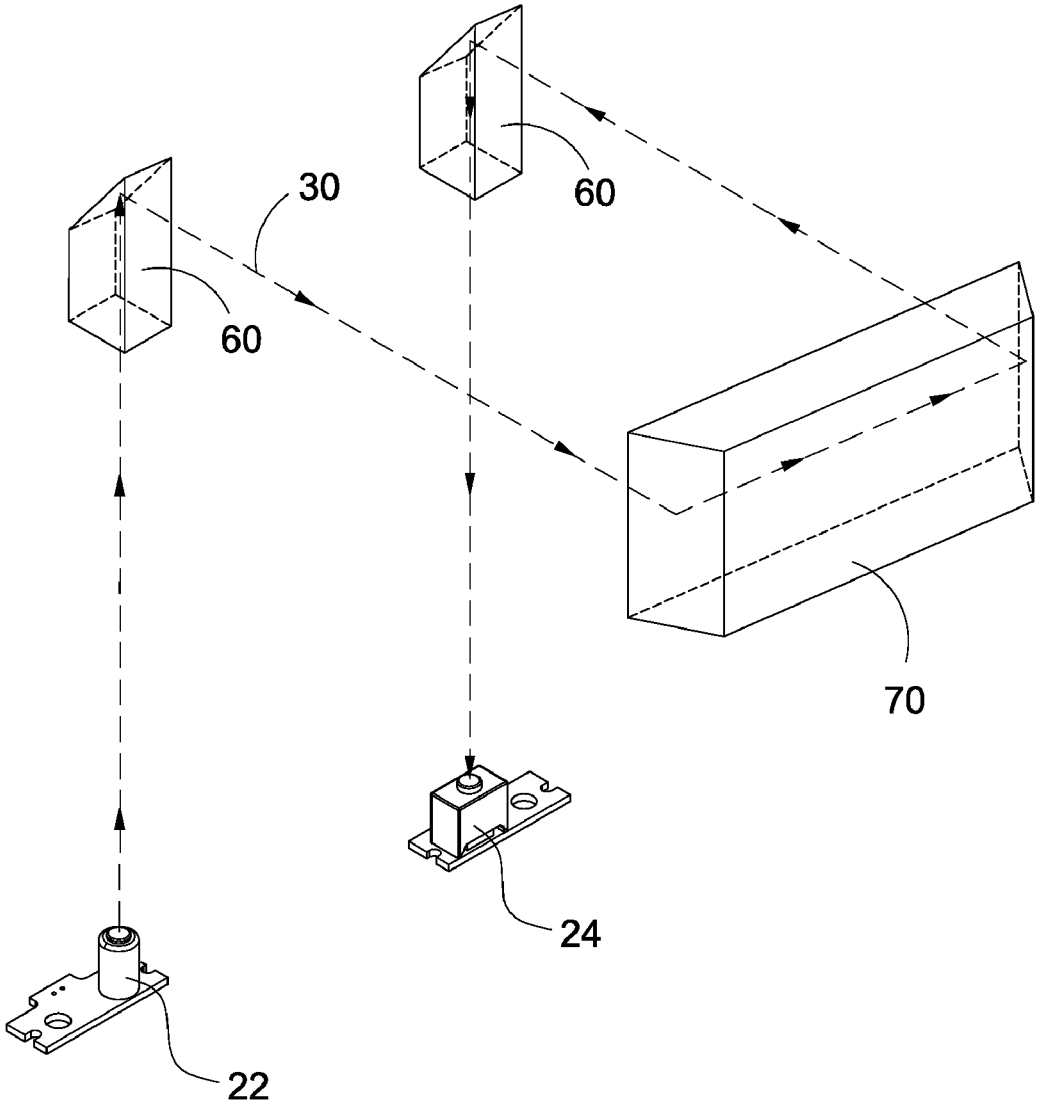
FIG. 12 is a schematic view of a foreign object detecting apparatus according to the ninth embodiment of the present invention.

FIG. 10, FIG. 11 and FIG. 12 respectively show the foreign object detecting apparatus 20 according to the seventh, the eighth and the ninth embodiments of the present invention, which is similar to the foreign object detecting apparatus 20 according the sixth embodiment. The difference is that there is at least one reflective device 60 used for redirecting the path of the coherent laser beam 30. Such that the foreign object detecting apparatus 20 can be adapted to various types of automatic trading machine. The reflective device 60 is a prism.

The foreign object detecting apparatus 20 utilized the first light detector 24 to receive and measure the intensity of the coherent laser beam, and utilized the second light detector 26 to receive at least a portion of the coherent laser beam 30 which is reflected, refracted, diffracted or scattered by the foreign object, such that the presence of the foreign object is discovered in the bill passageway 16.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An foreign object detecting apparatus in bill passageway (20), which is arranged in a bill validator and used to detect the presence of a foreign object in a bill passageway(16), the bill passageway(16) has a top side(161), a bottom side(162), a first lateral side(163) and a second lateral side(164) opposite to the first lateral side(163), the foreign object detecting apparatus in bill passageway(20) comprising:

a laser light source(22) arranged in the first lateral side (163) to emit a coherent laser beam toward the second lateral side(164) only;

a first light detector(24) arranged in the second lateral side(164) to receive the coherent laser beam and to measure the intensity of the coherent laser beam; and a second light detector(26) arranged in one of the top side(161) and the bottom side(162), wherein after a bill (100) passing through the bill passageway (16), if there is nothing in the bill passageway (16), the first light detector (24) can measure a predetermined intensity of the coherent laser beam (30) and the second light detector (26) can not detect any light; when a foreign object is presence in the bill passageway(16), the intensity of the coherent laser beam received by the first light detector (24) is decreased by the blocking of the foreign object, and at least a portion of the coherent laser beam which is reflected, refracted, diffracted or scattered by the foreign object is received by the second light detector(26).

2. The foreign object detecting apparatus in bill passageway(20) according to claim 1, wherein the second light detector(26) comprises a circuit board(265), a plurality of light detecting chips(266) arranged on the circuit board(265) and a lens set(264) arranged above the light detecting chips(266).

3. The foreign object detecting apparatus in bill passageway(20) according to claim 1, further comprising a third light detector(50) arranged in the other one of the top side(161) and the bottom side(162).

4. The foreign object detecting apparatus in bill passageway(20) according to claim 3, wherein the third light detector (50) comprises a circuit board(265), a plurality of light detecting chips(266) arranged on the circuit board(265) and a lens set(264) arranged on the light detecting chips(266).

5. The foreign object detecting apparatus in bill passageway(20) according to claim 1, further comprising a reflecting device (60) used for redirecting the coherent laser beam emitted from the laser light source(22) to the second lateral side (164).

6. The foreign object detecting apparatus in bill passageway(20) according to claim 5, wherein the reflecting device (60) is a prism.

7. The foreign object detecting apparatus in bill passageway(20) according to claim 1, further comprising a reflecting device (60) used for redirecting the coherent laser beam from the first lateral side(163) to the first light detector(24).

8. The foreign object detecting apparatus in bill passageway(20) according to claim 7, wherein the reflecting device (60) is a prism.

9. The foreign object detecting apparatus in bill passageway(20) according to claim 1, wherein the laser light source (22) is a laser diode.

10. An foreign object detecting apparatus in bill passageway(20), which is arranged in a bill validator and used to detect the presence of a foreign object in a bill passageway (16), the bill passageway(16) has a top side(161), a bottom side(162), a first lateral side(163) and a second lateral side (164) opposite to the first lateral side(163), the foreign object detecting apparatus in bill passageway(20) comprising:

a laser light source(22) arranged in the first lateral side (163) to emit a coherent laser beam toward the second lateral side(164) only;

a reflector(70) arranged in the second lateral side(164) to reflect the coherent laser beam back to the first lateral side(163);

a first light detector(24) arranged in the first lateral side (163) to receive the coherent laser beam reflected by the reflector(70) and to measure the intensity of the coherent laser beam; and a second light detector(26) arranged in one of the top side(161) and the bottom side(162), wherein after a bill (100) passing through the bill passageway (16), if there is nothing in the bill passageway (16), the first light detector (24) can measure a predetermined intensity of the coherent laser beam (30) and the second light detector (26) can not detect any light; when a foreign object is presence in the bill passageway(16), the intensity of the coherent laser beam received by the first light detector (24) is decreased by the blocking of the foreign object, and at least a portion of the coherent laser beam which is reflected, refracted, diffracted or scattered by the foreign object is received by the second light detector(26).

11. The foreign object detecting apparatus in bill passageway(20) according to claim 10, wherein the second light detector(26) comprises a circuit board(265), a plurality of light detecting chips(266) arranged on the circuit board(265) and a lens set(264) arranged above the light detecting chips (266).

12. The foreign object detecting apparatus in bill passageway(20) according to claim 10, further comprising a third light detector(50) arranged in the other one of the top side (161) and the bottom side(162).

13. The foreign object detecting apparatus in bill passageway(20) according to claim 12, wherein the third light detector(50) comprises a circuit board(265), a plurality of light detecting chips(266) arranged on the circuit board(265) and a lens set(264) arranged on the light detecting chips(266).

14. The foreign object detecting apparatus in bill passageway(20) according to claim 10, further comprising a reflecting device (60) used for redirecting the coherent laser beam emitted from the laser light source(22) to the second lateral side(164).

15. The foreign object detecting apparatus in bill passageway(20) according to claim 14, wherein the reflecting device (60) is a prism.

16. The foreign object detecting apparatus in bill passageway(20) according to claim 10, further comprising a reflecting device (60) used for redirecting the coherent laser beam from the first lateral side(163) to the first light detector(24).

17. The foreign object detecting apparatus in bill passageway(20) according to claim 16, wherein the reflecting device (60) is a prism.

18. The foreign object detecting apparatus in bill passageway(20) according to claim 10, wherein the laser light source (22) is a laser diode.

19. The foreign object detecting apparatus in bill passageway(20) according to claim 10, wherein the reflector(70) is a prism.

* * * * *